US005947525A

United States Patent [19]

Pollman

[11] Patent Number: 5,947,525

[45] Date of Patent: Sep. 7, 1999

[54] INDEX DIVIDER LABEL APPLICATION AND ALIGNMENT KIT AND METHOD OF USING SAME

[75] Inventor: Russ Pollman, Long Beach, Calif.

[73] Assignee: Avery Dennison Corporation, Pasadena, Calif.

[21] Appl. No.: 08/844,093

[22] Filed: Apr. 18, 1997

[51] Int. Cl.[6] ..... G09F 3/00; G09F 3/10

[52] U.S. Cl. ..... 283/36; 283/37; 283/38; 283/39; 283/40; 283/41; 283/42; 402/79; 281/38; 40/359; 40/360

[58] Field of Search ..... 283/36, 37, 38, 283/39, 40, 41, 42; 402/79; 281/38; 40/359, 360

[56] References Cited

U.S. PATENT DOCUMENTS

| | | | |
|---|---|---|---|
| 3,282,268 | 11/1966 | Jacobs . | |
| 3,807,069 | 4/1974 | Daley | 283/39 |
| 3,938,268 | 2/1976 | Gilhula . | |
| 4,329,191 | 5/1982 | Barber . | |
| 4,335,172 | 6/1982 | Sato . | |
| 4,445,711 | 5/1984 | Cunningham . | |
| 4,523,776 | 6/1985 | Barber . | |
| 4,832,374 | 5/1989 | Prest, Jr. . | |
| 4,927,179 | 5/1990 | Ehret et al. . | |
| 5,007,191 | 4/1991 | Klein | 402/79 |
| 5,039,131 | 8/1991 | Scholtysik . | |
| 5,129,682 | 7/1992 | Ashby . | |
| 5,143,466 | 9/1992 | Baldwin et al. . | |
| 5,182,152 | 1/1993 | Ericson . | |
| 5,243,173 | 9/1993 | Dunn . | |
| 5,271,642 | 12/1993 | Jahier et al. . | |
| 5,288,107 | 2/1994 | Johnson et al. . | |
| 5,330,230 | 7/1994 | Craig . | |
| 5,468,085 | 11/1995 | Kline | 283/37 |
| 5,503,435 | 4/1996 | Kline . | |
| 5,503,436 | 4/1996 | Alpaugh et al. . | |
| 5,543,191 | 8/1996 | Dronzek, Jr. et al. . | |
| 5,547,227 | 8/1996 | Laurash et al. . | |

*Primary Examiner*—Willmon Fridie, Jr.
*Assistant Examiner*—Mark T. Henderson
*Attorney, Agent, or Firm*—Oppenheimer Wolff & Donnelly LLP

[57] ABSTRACT

An improved index divider label application kit that includes at least one set of divider sheets and at least one set of precut labels removably attached to carrier strips which are removably secured to a backing sheet. The divider sheets have outwardly extending tabs vertically offset from one another for receiving the precut labels. The precut labels are spaced apart on the carrier strips to align substantially with the tabs on the divider sheets. A user may (1) separate a carrier strip and precut labels affixed to that carrier strip from the backing sheet, (2) place and align the carrier strip across the divider sheets such that the precut labels are placed on the tabs of the divider sheets, and (3) pull the carrier strip upwardly and away from the divider sheets such that the precut labels separate from the carrier strip and remain on the divider tabs.

19 Claims, 3 Drawing Sheets

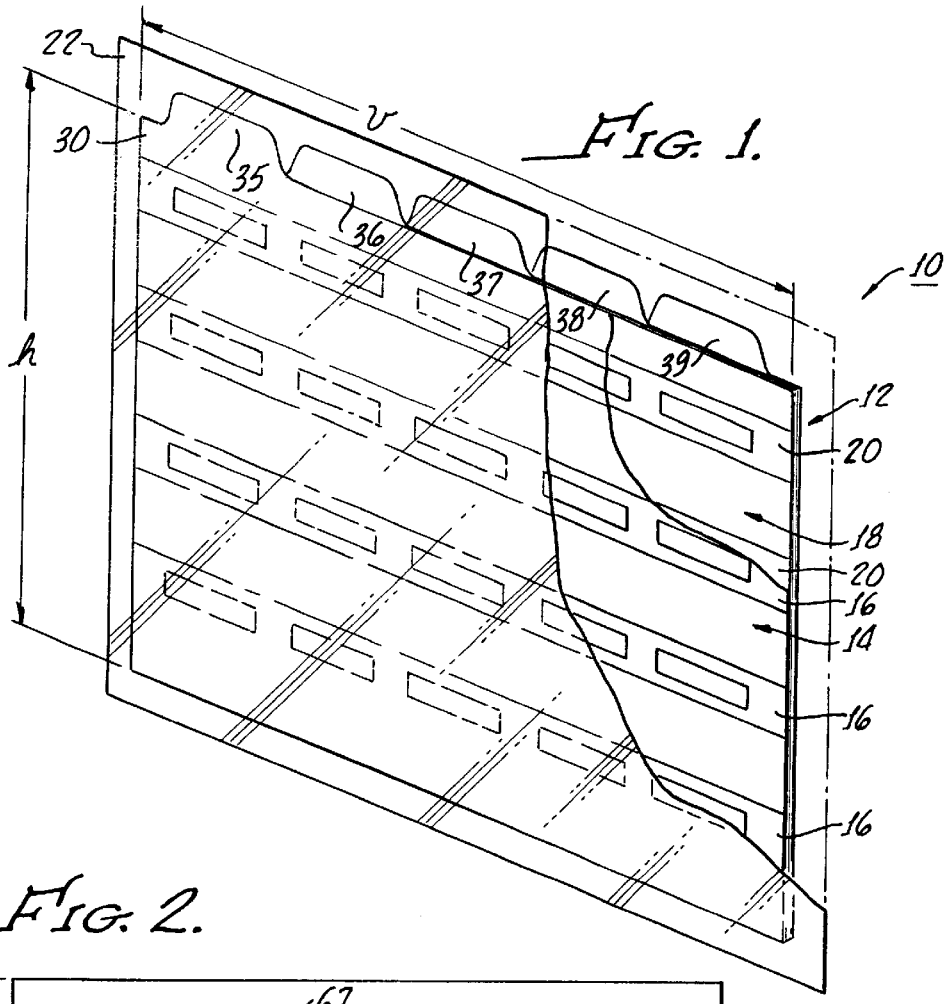
FIG. 1.
FIG. 2.
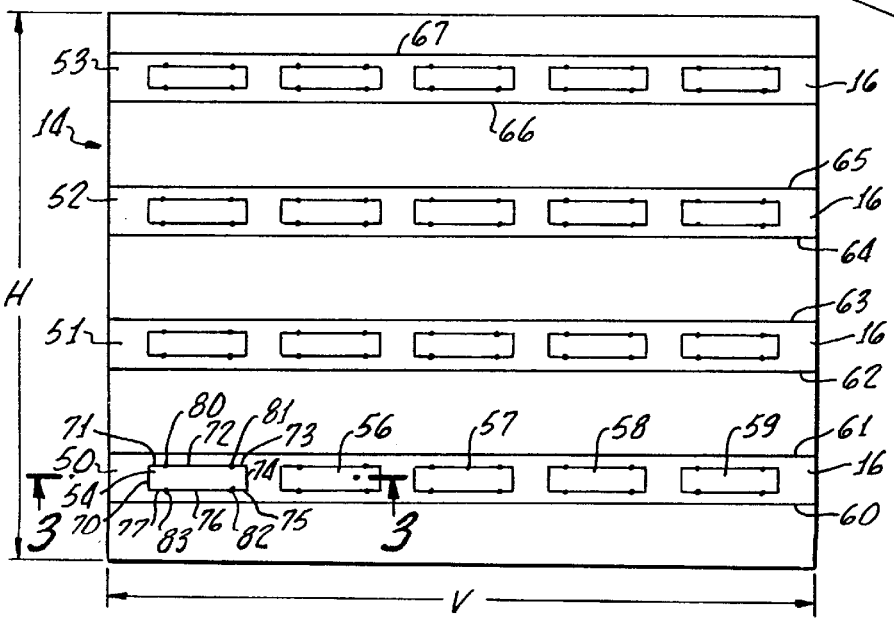
FIG. 3.
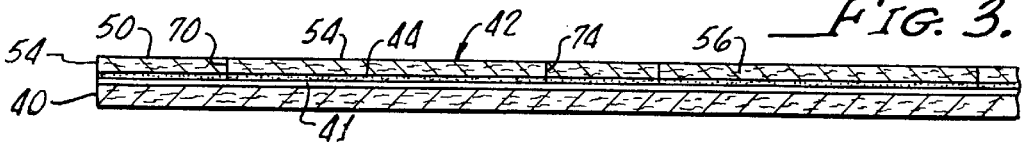

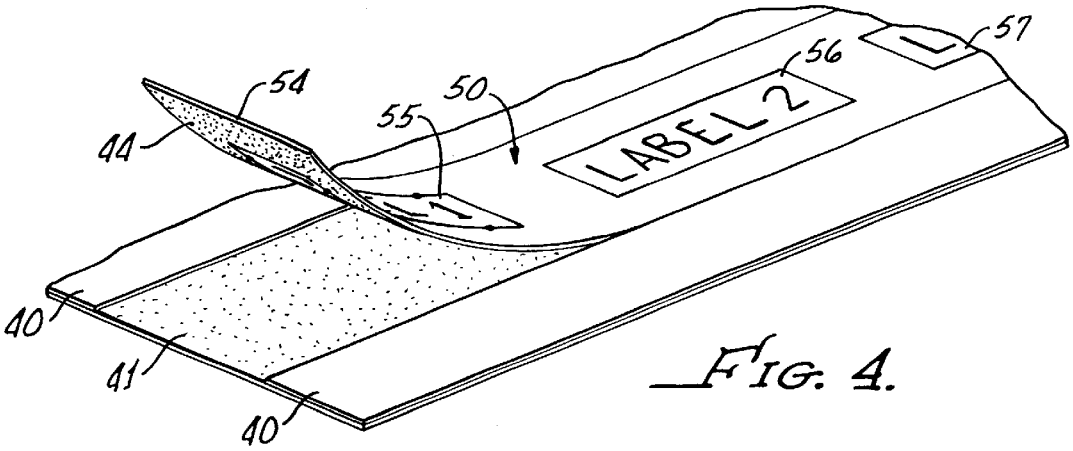
FIG. 4.
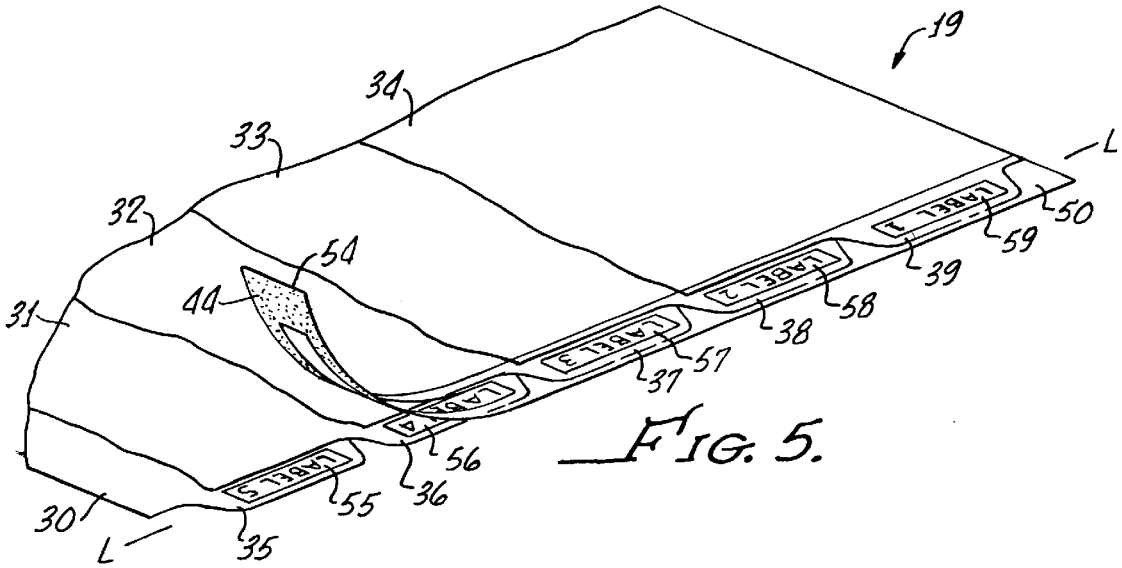
FIG. 5.
FIG. 6.
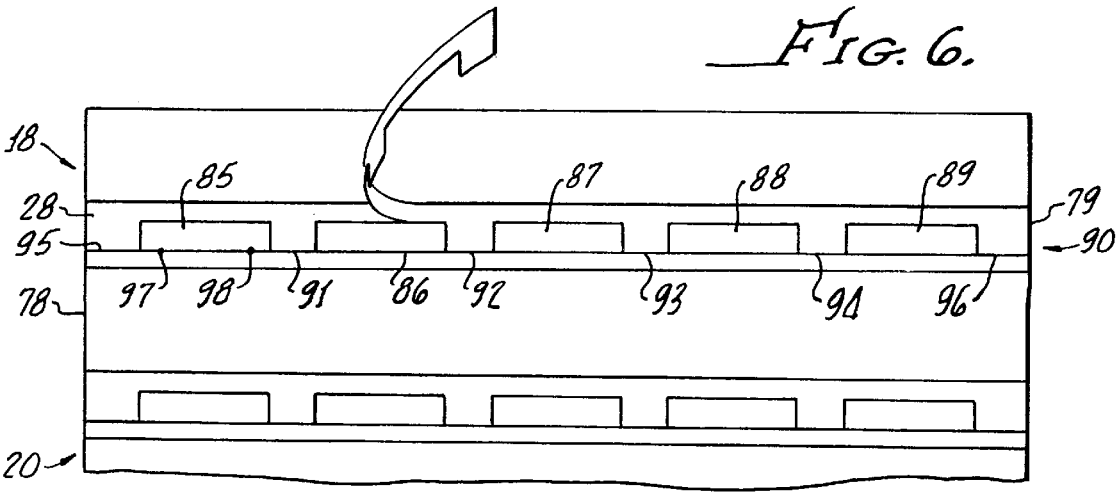

INDEX DIVIDER LABEL APPLICATION AND ALIGNMENT KIT AND METHOD OF USING SAME

TECHNICAL FIELD

The present invention relates in general to an improved index divider label application kit and a method of using same. The invention more particularly relates to a kit and method of using the kit for organizing and indexing documents where the kit includes index divider sheets and a pressure sensitive label sheet for facilitating the labeling of the divider sheets in a fast and efficient manner.

BACKGROUND ART

There have been many types and kinds of indexing and labeling systems to facilitate the organization of documents in a convenient manner. For example, reference may be made to the following U.S. Pat. Nos.: 3,282,268; 3,938,268; 4,329,191; 4,335,172; 4,445,711; 4,523,776; 4,832,374; 4,927,179; 5,039,131; 5,129,682; 5,143,466; 5,182,152; 5,243,173; 5,271,642; 5,288,107; 5,330,230; 5,468,085; 5,503,435; 5,503,436; 5,543,191; and 5,547,227.

As disclosed in the foregoing mentioned patents, various systems for indexing documents utilizing dividers and labels are available. More particularly, groups of documents are separated by divider sheets to help identify the types and kinds of documents. To help a user locate the type or kind of document distinguished by a given divider, dividers include outwardly extending tabs where the tabs of the individual dividers are vertically offset from one another and include indicia for helping a user to located and organize documents.

While such systems may have been satisfactory for helping to index groups of documents, the task of applying identifying indicia or identifying labels to the divider tabs is time consuming, clumsy and subject to error. In this regard, applying indicia to individual tabs has been difficult, and thus, tab attachable labels have been employed to help overcome such difficulties. Even though the use of attachable labels may have permitted the divider tabs to have identifying indicia, such labels have not been convenient to use, as such labels must be separated from one another and then attached individually to corresponding ones of the divider tabs. Further, in the course of individually applying the labels, they are often not applied evenly, or properly aligned with the divider sheet tabs.

Therefore it would be highly desirable to have a new and improved index divider label application kit and method of using the kit to facilitate the application of tab labels in a fast, efficient, and accurately aligned manner. Such a new and improved kit and method should enable a user to apply all of the divider tab labels substantially simultaneously.

DISCLOSURE OF INVENTION

Therefore, the principal object of the present invention is to provide a new and improved index divider label application kit and method of using same, wherein all of the divider tab labels for a given set of dividers can be applied substantially simultaneously, and with the labels accurately aligned with the dividers.

Briefly, the above and further objects of the present invention are realized by providing a new and improved index divider label application kit which can be utilized to separate and help identify groups of different types and kinds of documents according to a novel label application method of the present invention.

The index divider label application kit includes at least one set of precut, pressure sensitive divider tab labels disposed on a backing sheet and at least one set of divider sheets, each having outwardly extending tabs vertically offset from one another for receiving the divider tab labels. The labels are spaced from one another in the same offset manner as the divider tabs and the labels are attached removably to a precut strip that is secured removably to the backing sheet. A set of ties hold the pre-cut labels to the strip.

According to the novel method of label application, the precut strip is pulled from the backing sheet, along with the offset labels. The strip with labels is then aligned over a set of stacked dividers so that the labels and divider tabs are in corresponding alignment with one another. The strip is then laid in engagement with the top divider and then, using finger pressure, each label is pressed into engagement with its corresponding tab. The strip is then pulled away from the divider sheets, hesitating slightly at each tie allowing the ties to tear, leaving each label perfectly positioned on and aligned with its corresponding tab.

BRIEF DESCRIPTION OF DRAWINGS

The above-mentioned and other objects and features of this invention and manner of attaining them will become apparent, and the invention itself will be best understood by reference to the following description of the embodiments of the invention taken in conjunction with the accompanying drawings, wherein:

FIG. 1 is a pictorial view of an index divider label application and alignment kit, which is constructed in accordance with the present invention;

FIG. 2 is a front elevational view of a pressure sensitive label sheet forming part of the kit of FIG. 1;

FIG. 3 is a fragmentary cross-sectional view of the label sheet of FIG. 2 taken along line 3—3 of FIG. 2;

FIG. 4 is an enlarged fragmentary pictorial view of a partially removed frame strip forming part of label sheet of FIGS. 2 and 3;

FIG. 5 is a fragmentary pictorial view of an applied set of labels being separated from the frame strip shown in FIG. 4;

FIG. 6 is a fragmentary front plan view of another pressure sensitive label sheet forming part of the kit of FIG. 1;

DETAILED DESCRIPTION OF PREFERRED EMBODIMENTS

Figure 7:
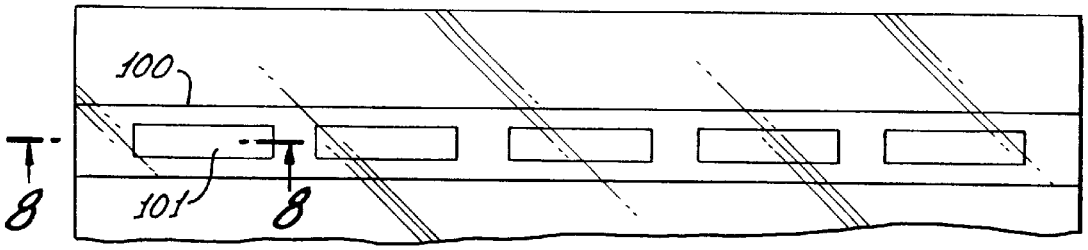
FIG. 7 is a fragmentary pictorial view of a another embodiment of transparent label with adhesive material on labels only.

Referring now to the drawings, and more particularly to FIG. 1 thereof, there is shown an index divider label application kit 10 which is constructed in accordance with the present invention. The kit 10 can be utilized to facilitate the application of a set of divider tab labels to a set of divider tabs in a fast and efficient manner in accordance with the label application method of the present invention.

The kit 10 generally comprises a set of dividers 12 for helping to separate groups of different types and kinds of documents (not shown), and a pressure sensitive label sheet 14 having a set of transparent labels 16 mounted removably thereon.

The kit 10 also includes a pressure sensitive label sheet 18 having a set of opaque labels 20 mounted removably thereon. For purposes of displaying and marketing the kit 10, the set of dividers 12 and the pressure sensitive label sheets 14 and 18 are enclosed in a product package 22 that includes an eye-catching design (not shown) on its front face.

The set of dividers 12 includes five individual divider sheets, such as divider sheets 30–34 (see FIG. 5), for use in separating the groups of different types and kinds of documents. In the preferred embodiment of the present invention, the divider sheets 30–34 are each about 8.5 inches in width and about 11.0 inches in length and each includes outwardly extending tabs, such as the tabs 35–39 that are vertically offset from one another along the vertical axis of the dividers 30–34. The divider tabs 35–39 each extend outwardly from the perimeter of their respective dividers 30–34 by about 0.5 inches and each tab is about 2.0 inches in length.

Although in the preferred embodiment of the present invention a set of five divider sheets and two different types of label sheets is disclosed, divider sheets and label sheets of greater and lesser amount are contemplated within the true scope and spirit of the present invention. Accordingly, the number of divider sheets and label sheets within the kit may be in any combination between two and twenty sheets.

The pressure sensitive label sheet 14 may be dimensioned to about the same dimensions of an individual one of the divider sheets, such as the divider sheet 30. In this regard, the label sheet 14 is about 8.5 inches in width and about 11.0 inches in length.

As best seen in FIG. 3, the label sheet 14 is multi-layered having a backing sheet 40 and a face sheet 42. A pressure sensitive layer of adhesive material 44 is disposed on a bottom face 46 of the face sheet 42 for removably securing together the backing sheet 40 and the face sheet 42. As is customary, a very thin release coating of material 41, such as a silicone coated material, may be applied to the backing sheet 40, to facilitate removal of the labels and associated label strips.

In order to facilitate the application of the labels to the divider sheets 30–34, the face sheet 42 is divided into a plurality of frame or label carrier strips, such as the frame strips 50–53 (FIG. 2). The face sheet 42 is die cut into strip segments by face sheet cut lines 60–67 that extend or traverse the entire longitudinal length of the face sheet 42. Although the face sheet 42 is cut into strips 50–53, those skilled in the art will understand that the face sheet 42 remains secured to the backing sheet 40 due to the pressure sensitive adhesive material 44.

In this manner, the strips 50–53 remain in contact with the backing sheet 40 until individual ones of the strips, such as the strip 50, is grasped at one of its terminal ends, such as the terminal end 54, and pulled upwardly and laterally away from the backing sheet 40 until it is completely separated from the backing sheet 40 and the remaining portion or portions of the face sheet 42.

As each of the frame strips 50–53 are substantially identical, only frame strip 50 will be described in greater detail.

Considering now the frame strip 50 in greater detail with reference to FIGS. 2–4, the set of labels 16 includes five equally spaced apart like dimensioned transparent labels 55–59. As will be explained hereinafter in greater detail, each of the labels 55–59 are precut to a rectangular dimension that corresponds to about the same rectangular dimension as an individual one of the divider tabs, such as the divider tab 35. The precut labels 55–59 are held or secured removably to the face sheet 42 by a plurality of ties areas 80–83 that will be described hereinafter in greater detail.

Considering now the method of using the index divider label application kit 10 in greater detail with reference to FIGS. 1–5, the product package 22 is opened and the set of dividers 12 and the set of pressure sensitive label sheets 14 and 18 are removed therefrom.

Next the divider sheets 30–34 are stacked one on top of the other to form a stack, such as a stack 19 (FIG. 5). While forming the stack 19, the user simultaneously aligns the divider sheets 30–34, so their respective tabs 35–39 are aligned spaced apart from one another along a common longitudinal axis (L) of the dividers 30–34 and in a series of closely spaced apart parallel planes. Each parallel plane being defined by the thickness of a corresponding one of the dividers.

The parallel planes are closely spaced relative to one another, so that the vertical distance between the top plane and the bottom plane is considered insignificant for the purposes of alignment as will be described hereinafter in greater detail.

The user then selects a desired one of the pressure sensitive label sheets 14 and 18 based upon whether the user desires to utilize transparent labels, such as the transparent labels 16, or opaque labels, such as the opaque labels 20. Appropriate indexing information is then typed or computer printed onto the individual labels.

Once the user selects for example, the pressure sensitive label sheet 14, the user grasps one of the frame strips of the label sheet 14, such as the frame strip 50, and pulls its terminal end 54 upwardly and laterally away from the backing sheet 40, as best seen in FIG. 4, until the frame strip 50 is completely separated from the backing sheet 40.

The frame strip 50, with its associated set of attached labels 55–59, is then moved into alignment over the stack 19 relative to its associated divider tabs 35–39 and then down onto the stack 19 of aligned divider sheets 30–34 while aligning the labels 55–59 with respective ones of the divider tabs 35–39. The frame strip 50 functions as a long lever arm that helps the user gauge parallelism to tab edges visually so that alignment of the labels 55–59 on the divider tabs 35–39 is greatly improved relative to applying labels one by one as accomplished under prior art methods of attachment and alignment.

When the labels 55–59 are resting in engagement with respective ones of the divider tabs 35–39, the user engages the top surface of each label with his or her finger, and using finger pressure, presses each label into engagement with it associated divider tab. The finger pressure is sufficient to cause that portion of the pressure sensitive layer of adhesive material 44 disposed on the bottom face 46 of the label to securely fasten the label to its associated divider tab.

As best seen in FIG. 5, once each label has been secured to a corresponding one of the divider tabs, the user again grasps the terminal end 54 of the frame strip 50 and pulls it upwardly and away from the stack 19 hesitating at each label for a slight moment to allow the pulling force to tear the label ties associated with each label. In this manner, each of the labels 55–59 are successively affixed to their respective divider tabs 35–39 in a substantially continuous manner.

After the labels 55–59 have been secured to the divider 30–34, the dividers 30–34, may be secured in a notebook (not shown) or other means for holding dividers and documents and utilized to separate the different types and kinds of documents to be carried in the notebook.

Although in the preferred embodiment of the present invention the label indica may be typed or printed, it is contemplated that labels may also be preprinted with desired indexing information. As is customary, a very thin transparent coating of an indica holding material may be applied to the face surface of the labels to facilitate preprinting with desired indexing information.

Considering now the frame strip 50 in still greater detail with reference to FIGS. 2 and 3, each of the labels 55–59 affixed to the strip 50 are substantially identical. Accordingly, only the label 55 will be described hereinafter in greater detail. In this regard, the reference characters mentioned with respect to label 55 apply to each individual one of the label 56–59.

As best seen in FIG. 2, the transparent label 55 is defined by a plurality of label die cut lines 70–77 that are arranged in the strip 50 to form a generally rectangularly shaped label configuration.

In order to hold or secure the label configuration to carrier strip 50, the label 55 is further defined by a set of vertically and horizontally spaced apart tie area 80–83. The tie areas 80–83 affix the label 55 to the strip 50.

The ties 80–83 are small uncut sheet material areas that help couple the cut lines 70–77 into the rectangularly shaped label configuration. In this regard, the tie 80 interconnects the cut lines 71 and 72; the tie 81 interconnects the cut lines 72 and 73; the tie 82 interconnects the cut lines 75 and 76; and the tie 83 interconnects the cut lines 76 and 77.

In order to assure that the label 55 will be separated from the strip 50, the ties 80 and 83 are inset from the cut line 70 by about 0.125 inches each while the ties 81 and 82 are inset from the cut line 74 by the same distance of about 0.125 inches.

From the foregoing, those skilled in the art will understand that the small uncut tie areas 80–83 secure the label 55 to the strip 50 with a sufficient amount of force to prevent the label 55 from separating from the strip 50 when it is pulled away and separated from the backing sheet 40, but such uncut tie areas do not secure the label 55 to the strip 50 with a sufficient amount of force to prevent the label from separating from the strip 50 when its is pulled away from the stack 19. More particularly, those skilled in the art will understand that the finger pressure of the user utilized to secure the label 55 to the tab divider 35 causes the adhesive material 44 to grip the tab divider 35 with a greater amount of force than the face sheet 42 and its associated strips 50–54. This difference in hold strength is attributed to the fact that the backing sheet 40 has a very thin release coating 41 disposed thereon.

In order to help facilitate proper placement of the label 55 on its associated tab divider 35, the label 55 is about 0.375 inches tall and about 1.50 inches wide. Thus, the label 55 will fit within the tab divider area which is 0.5 inches by 2.0 inches.

Considering now the pressure sensitive label sheet 14 in still greater detail with reference to FIGS. 2–4, the backing sheet 40 and the face sheet 42 each have a horizontal dimension (H) and a vertical dimension (V) that corresponds substantially to the horizontal dimension (h) and the vertical dimension (v) of an individual one of the dividers, such as the divider 35. In this regard, the horizontal dimension (H) is about 8.5 inches, while the vertical dimension (V) is about 11.0 inches.

Considering now the pressure sensitive label sheet 18 in greater detail with reference to FIG. 6, the label sheet 18 is substantially identical to the label sheet 14 except for the location of the adhesive material and the arrangement of its cut lines.

As been seen in FIG. 6, the set of opaque labels 20 includes five spaced apart labels 85–89 that are substantially identical in shape to labels 55–59. The label sheet 18 is divided into a plurality of base or carrier strips, such as a base strip 90 where each of the labels 85–89 carried thereon are connected in series. In this regard, the base strip 90 includes a plurality of base cut lines 91–94 that interconnect the labels 85–89 in series.

For example, the base cut line 91 extends between the labels 85 and 86; the base cut line 92 extends between the labels 86 and 87; the base cut line 93 extends between the labels 87 and 88; and the base cut line 94 extends between the labels 88 and 89.

A pair of outer base cut lines 95 and 96 respectively, help extend the series connection to the outer periphery of the strip. In this regard, the base cut line 95 extends between the label 85 with an outer perimeter side 78 of the label sheet 18 to facilitate the complete separation of the label 85 from the sheet 18. In a like manner, the series extends to an opposite outer perimeter side 79 of the label sheet 18 by the base cut line 96 to facilitate the complete separation of the label 89 from the sheet 18. The base strip 90 holds the labels 85–89 in alignment as they are applied to the index tabs in a manner similar to the showing of FIG. 5.

A lesser number of ties hold each of the labels 85–89 to the base strip 90. In this regard for example, a pair of ties 97 and 98 hold the label 85 to the base strip 90.

Figure 11:
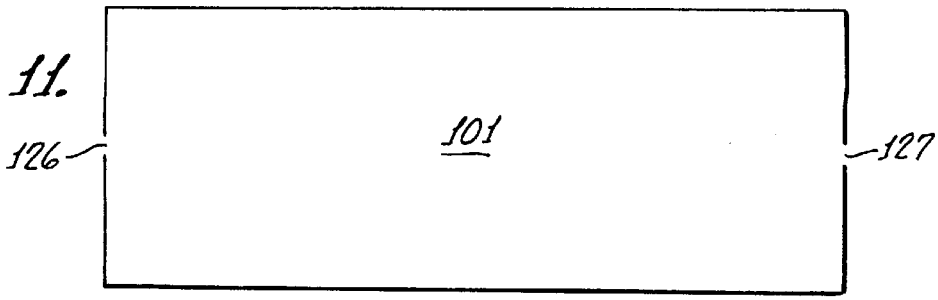
FIG. 11 is a greatly enlarged view of a precut label forming part of the frame strip of FIG. 7.

Although in the preferred embodiment of the present invention the ties are shown in offset pairs, such as the tie pair 97 and 98, it is contemplated that ties may be arranged in other configurations for holding labels to carrier sheets. For example as best seen in FIGS. 7, 8, and 11, a label 101 is held to a precut die strip 100 by a set of ties 126–127 that are centrally disposed on each end of the label 101.

Figure 8:
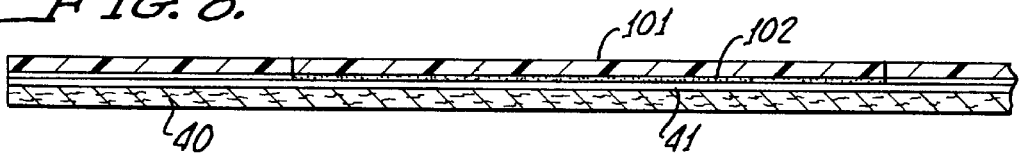
FIG. 8 is a fragmentary cross-sectional view of the label sheet of FIG. 7 taken along line 8—8 thereof.
Figure 9:
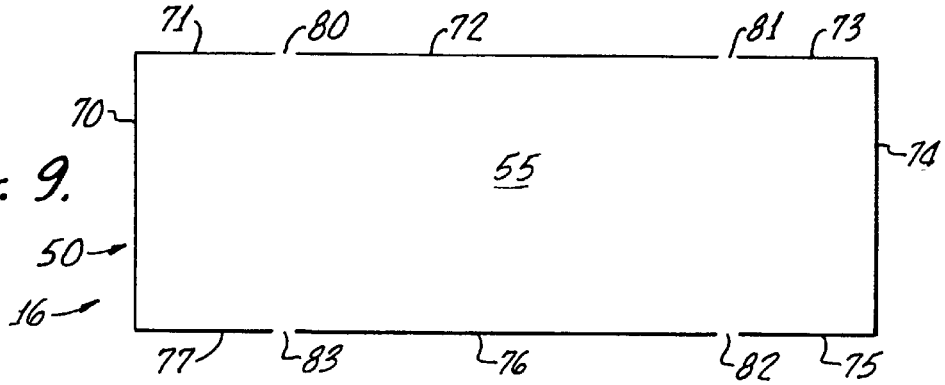
FIG. 9 is a greatly enlarged view of a precut label forming part of the frame strip of FIG. 4.
Figure 10:
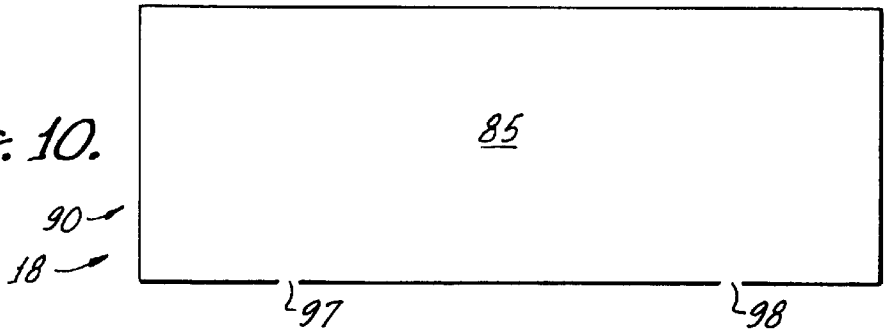
FIG. 10 is a greatly enlarged view of a precut label forming part of the base strip of FIG. 6.

As best seen in FIG. 8, a pressure sensitive layer of adhesive material 102 is disposed on only the bottom face of each of the strip labels, such as the label 101.

From the forgoing, it should be understood by those skilled in the art that while specific tie configurations have been illustrated, different configurations of ties are contemplated within the true spirit and scope of the present invention.

While particular embodiments of the present invention have been disclosed, it is to be understood that various different modifications are possible and are contemplated within the true spirit and scope of the appended claims. For example, the divider sheets 30–35 are described as having divider tabs that extend along the longitudinal axis of the divider. It is contemplated within the true spirit and scope of the embodiments that the divider tabs could extend outwardly along the transverse axis of the divider. Accordingly, the configuration of the sheets 14 and 18 would need to be modified to accommodate the different divider configuration. Thus, there is no intention, therefore, of limitations to the exact abstract or disclosure herein presented.

I claim:

1. An index divider label application kit, comprising:

at least one set of divider sheets, each having outwardly divider tabs vertically offset from one another in a predetermined arrangement when said divider sheets overlay one another;

at least one carrier type pressure sensitive label sheet having a backing sheet and a face sheet secure removably together by a layer of pressure sensitive adhesive material;

said face sheet including a plurality of spaced apart carrier strips each secured removably to said backing sheet and to said face sheet;

each of said carrier strips includes a plurality of spaced apart precut labels aligned in an alignment configuration that corresponds substantially to said predetermined arrangement of the divider tabs extending outward from said divider sheets such that when each of said carrier strips overlies said divider tabs on said set of divider sheets, each of said precut labels is located on top of a respective divider tab; and said precut labels being affixed to said carrier strips such that said labels do not tear from said carrier strips when said carrier strips are separated from said backing sheet and said face sheet;

whereby a user may (1) separate a carrier strip and precut labels affixed to that carrier strip from the backing sheet and the face sheet, (2) place and align the carrier strip across the divider sheets such that the precut labels affixed to the carrier strip are placed on the divider tabs of the divider sheets, and (3) pull the carrier strip upwardly and away from the divider sheets such that the precut labels tear from the carrier strip and remain on the divider tabs.

2. An index divider label application kit according to claim 1, further comprising:

at least one base type pressure sensitive label sheet having a plurality of spaced apart base strips, wherein each base strip includes a plurality of spaced apart precut labels affixed to the base strip and interconnected in series along an imaginary base line extending the entire vertical dimension of the base strip, said imaginary base line being defined in part by a plurality of spaced apart base cut lines for helping to facilitate separation of the spaced apart precut labels from the base strip.

3. A label sheet, comprising:

a backing sheet having a thin coating of a releasing agent disposed on the front face thereof;

a face sheet removably affixed to said front face of the backing sheet in an overlying aligned manner, said face sheet having at least one set of precut pressure sensitive divider tab labels affixed removably thereto;

said divider tab labels being spaced part from one another in an offset manner that substantially corresponds to a set of vertically offset divider sheet tabs extending outwardly from a stacked group of divider sheets having a predefined arrangement of divider tabs;

a plurality of small area ties affixed to each individual divider tab label, each individual tie and divider tab label having a sufficient amount of pressure sensitive adhesive material coated on a bottom surface thereof to substantially prevent label divider tab separation as said divider tab labels are separated from said face sheet and applied to said set of vertically offset divider sheet tabs in a substantially continuous manner; and said face sheet includes a plurality of spaced apart face sheet die cut lines for separating said face sheet into a plurality of precut carrier strips.

4. A label sheet according to claim 3, wherein each individual precut carrier strip carries one set of precut pressure sensitive divider tab labels.

5. A label sheet according to claim 4, wherein each individual precut carrier strip is a frame strip.

6. A label sheet according to claim 4, wherein each individual precut carrier strip is a base strip.

7. A label sheet according to claim 3, wherein each individual divider tab label is transparent.

8. A label sheet according to claim 3, wherein each individual divider tab label is opaque.

9. A label sheet according to claim 3, wherein said face sheet has a thin coating of a pressure sensitive adhesive material on a bottom face thereof for removably securing together the backing sheet and the face sheet.

10. A label sheet according to claim 9, wherein said face sheet includes a plurality of spaced apart face sheet die cut lines for separating said face sheet into a plurality of precut carrier strips;

each individual one of said plurality of spaced apart carrier strips including a plurality of spaced apart precut labels aligned in an alignment configuration that corresponds substantially to the offset spacings of the vertically offset divider sheet tabs extending outwardly from said group of divider sheets; and each of said precut labels being affixed to its associated carrier strip by a set of said plurality of small area ties, said small area ties being sufficiently strong not to tear from the carrier strip when it is pulled upwardly and away from said backing sheet for separating the strip from both the backing sheet and the face sheet, but not sufficiently strong to prevent tearing from the carrier strip when the labels are pressed into engagement with individual ones of the divider tabs and the carrier strip is then pulled upwardly and away from the divider tabs.

11. A label sheet according to claim 9, wherein each precut label is defined partially by a set of label cut lines that are extended along a long axis of an associated label by horizontally and vertically spaced apart pair sets of the area ties.

12. A label sheet according to claim 9, wherein each precut label is defined by a set of spaced apart horizontal cut lines and a set of spaced apart vertical cut lines, each horizontal set of cut lines being interconnected by a pair of area ties.

13. A label sheet according to claim 12, wherein each precut label is generally rectangular in shape.

14. A label sheet according to claim 13, wherein said backing sheet has a horizontal dimension (H) and a vertical dimension (V), said vertical dimension (V) corresponding substantially to a vertical dimension (v) along which said successive tabs extend, on an individual one of the divider sheets in the set of divider sheets; and wherein said backing sheet and said face sheet have substantially the same horizontal and vertical dimensions.

15. A label sheet according to claim 14, wherein the horizontal dimension (H) of said backing sheet is about 8.5 inches and the vertical dimension (V) of said backing sheet is about 11.0 inches.

16. A label sheet according to claim 3, wherein said area ties are arranged in pairs of area ties, each pair of area ties affixing one of the divider tab labels to said face sheet.

17. A label sheet according to claim 16, wherein each of said divider tab labels has a generally rectangular shape defined by sets of parallel die cut lines.

18. A label sheet according to claim 17, wherein each pair of ties are inset from at least one set of the parallel die cut lines helping to define the rectangular shape.

19. A method of applying a set of precut labels to a corresponding set of offset divider tabs extending outwardly from divider sheets, comprising:

stacking the divider sheets in alignment with their divider tabs extending spaced apart along a single common axis of the divider sheets;

using a pressure sensitive label sheet having a backing sheet and a face sheet secured removably together by a layer of pressure sensitive adhesive material;

said face sheet including a plurality of spaced apart carrier strips each secured removably to said backing sheet and to face sheet;

each of said spaced apart carrier strips including a plurality of spaced apart divider tab labels aligned in an alignment spacing configuration that corresponds substantially to the offset spacings of the divider tabs extending outwardly from said set divider sheets;

each of said divider tab labels being affixed to its associated carrier strip by a plurality of small area ties;

grasping a terminal end of a user selected individual one of said plurality of carrier strips;

pulling the grasped carrier strip upwardly and away from said backing strip a sufficient distance to separate the carrier strip from the remaining portion of the face sheet attached to said backing sheet;

aligning the separated carrier strip over the stacked divider sheets;

bringing the carrier strip into engagement with the divider tabs of the stacked divider sheets so that each of said divider tab labels is in substantial alignment with a corresponding individual one of the divider tabs;

pressing said divider tab labels into engagement with their corresponding divider tabs with a sufficient finger pressure to assure said divider tab labels are affixed to the divider tab; and pulling the carrier strip upwardly and away from the stacked dividers a sufficient distance to separate said divider tab labels substantially simultaneously from the carrier strip and leaving the labels secured to the divider tabs.

* * * * *